US009403361B2

(12) United States Patent
Takabe

(10) Patent No.: US 9,403,361 B2
(45) Date of Patent: Aug. 2, 2016

(54) LIQUID EJECTING HEAD AND LIQUID EJECTING APPARATUS

(71) Applicant: SEIKO EPSON CORPORATION, Tokyo (JP)

(72) Inventor: Motoki Takabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/531,683

(22) Filed: Nov. 3, 2014

(65) Prior Publication Data

US 2015/0130877 A1 May 14, 2015

(30) Foreign Application Priority Data

Nov. 8, 2013 (JP) ..... 2013-231916

(51) Int. Cl.
*B41J 2/05* (2006.01)
*B41J 2/045* (2006.01)
*B41J 2/14* (2006.01)

(52) U.S. Cl.
CPC .... *B41J 2/14233* (2013.01); *B41J 2002/14491* (2013.01)

(58) Field of Classification Search
None
See application file for complete search history.

(56) References Cited

U.S. PATENT DOCUMENTS

2006/0176343 A1* 8/2006 Shimada et al. ..... 347/71
2006/0187269 A1* 8/2006 Takahashi ..... 347/68
2009/0213189 A1* 8/2009 Okubo ..... B41J 2/14233 347/71

FOREIGN PATENT DOCUMENTS

JP 2007-245589 9/2007

* cited by examiner

*Primary Examiner* — Erica Lin
(74) *Attorney, Agent, or Firm* — Workman Nydegger

(57) ABSTRACT

A liquid ejecting apparatus is provided with an actuator substrate on which a piezoelectric actuator that generates a pressure change in a pressure generation chamber, which is in communication with a nozzle opening that ejects a liquid, is provided. The liquid ejecting head is provided with lead-out wiring that is led out from the piezoelectric actuator to the top of the actuator substrate, the lead-out wiring is provided with an adhesive layer that is provided on an actuator substrate side, and a conductive layer that is provided on a side of the adhesive layer which is opposite the actuator substrate, and the adhesive layer has a width that is narrower than the conductive layer in at least a parallel arrangement direction of the lead-out wiring.

7 Claims, 6 Drawing Sheets

LIQUID EJECTING HEAD AND LIQUID EJECTING APPARATUS

The entire disclosure of Japanese Patent Application No: 2013-231916, filed Nov. 8, 2013 is expressly incorporated by reference herein in its entirety.

BACKGROUND

1. Technical Field

The present invention relates to a liquid ejecting head and a liquid ejecting apparatus which eject a liquid from a nozzle opening, and in particular, to an ink jet type recording head and an ink jet type recording apparatus which discharge ink as the liquid.

2. Related Art

An ink jet type recording head which is an example of a liquid ejecting head is provided with a piezoelectric actuator on one side of a flow channel formation substrate on which a pressure generation chamber, which is in communication with a nozzle opening, is provided, and ink droplets are discharged from the nozzle opening by generating a pressure change in ink inside the pressure generation chamber through driving of the piezoelectric actuator.

Lead-out wiring is led out from an electrode of the piezoelectric actuator that is provided on a side of the flow channel formation substrate to the top of a surface side of the flow channel formation substrate, and connection wiring that is connected to a driving circuit or the like is connected to the lead-out wiring (for example, refer to Japanese Patent No. 4877481).

This kind of wiring that is led to the top of a flow channel formation substrate is configured by laminating an adhesive layer and a conductive layer in order to improve adhesion with the piezoelectric actuator and adhesion with a surface side of the flow channel formation substrate.

However, there is a problem that there is a concern that metals that are ionized with most ease will be eluted when a voltage is applied to the lead-out wiring, and the wiring will short-circuit with adjacent wiring. In particular, in a case in which the lead-out wiring is formed with a high density due to a trend for increases in the density of piezoelectric actuators, an interval between mutually adjacent lead-out wiring is narrower, and it is more likely that a so-called leak path that short-circuits due to eluted materials will be formed. In addition, since a movement speed of ionized metals is proportional to field intensity, field intensity is higher due to the lead-out wiring being formed with a high density, and a leak path is formed in a short time.

In addition, there is a problem that if an adhesive layer is provided in the lead-out wiring, the adhesive strength of the lead-out wiring is reduced, and it becomes more likely that the lead-out wiring will peel.

Additionally, these kinds of problems are not limited to ink jet type recording heads, and are also found in liquid ejecting heads that eject other liquids.

SUMMARY

An advantage of some aspects of the invention is to provide a liquid ejecting head and a liquid ejecting apparatus that can suppress short-circuits in lead-out wiring and arrange the lead-out wiring with a high density.

According to an aspect of the invention, there is provided a liquid ejecting head including an actuator substrate on which a piezoelectric actuator that generates a pressure change in a pressure generation chamber, which is in communication with a nozzle opening that ejects a liquid, is provided. The liquid ejecting head is provided with lead-out wiring that is led out from the piezoelectric actuator to the top of the actuator substrate, the lead-out wiring is provided with an adhesive layer that is provided on an actuator substrate side, and a conductive layer that is provided on a side of the adhesive layer which is opposite the actuator substrate, and the adhesive layer has a width that is narrower than the conductive layer in at least a parallel arrangement direction of the lead-out wiring.

In this case, since the width of the adhesive layer is narrower than the conductive layer, an interval between adjacent adhesive layers is wide, and it is possible to increase the time to short-circuit due to eluted components even when components of the adhesive layer are eluted. In addition, since the interval between adjacent adhesive layers is wide, the field intensity is reduced, and therefore, the elution of components is suppressed. Furthermore, by securing the width of the conductive layer, it is possible to suppress a circumstance in which the electrical resistance of the lead-out wiring becomes high. Therefore, a high density arrangement of the lead-out wiring is possible.

In the liquid ejecting head, a groove portion that is open to a side surface of the lead-out wiring may be provided in the side surface.

In addition, in the liquid ejecting head, it is preferable that the conductive layer be formed to cover an end surface in the width direction of the adhesive layer. In this case, it is possible to further suppress the elution of components of the adhesive layer.

In addition, it is preferable that in addition to connection wiring of a wiring substrate being electrically connected to the lead-out wiring, the lead-out wiring and the actuator substrate, and the wiring substrate and the connection wiring be joined using an adhesive. In this case, in addition to peeling being unlikely since the lead-out wiring and the actuator substrate, and the wiring substrate and the connection wiring are joined using an adhesive, if the groove portion is formed in the side surface of the lead-out wiring, it is possible to further improve the joining strength using an anchor effect as a result of the inside of the groove portion being filled with the adhesive.

Furthermore, according to another aspect of the invention, there is provided a liquid ejecting apparatus including the liquid ejecting head of the abovementioned aspect.

In this case, it is possible to realize a liquid ejecting apparatus with improved reliability by suppressing short-circuits of the lead-out wiring.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail on the basis of embodiments.

Embodiment 1

Figure 1:
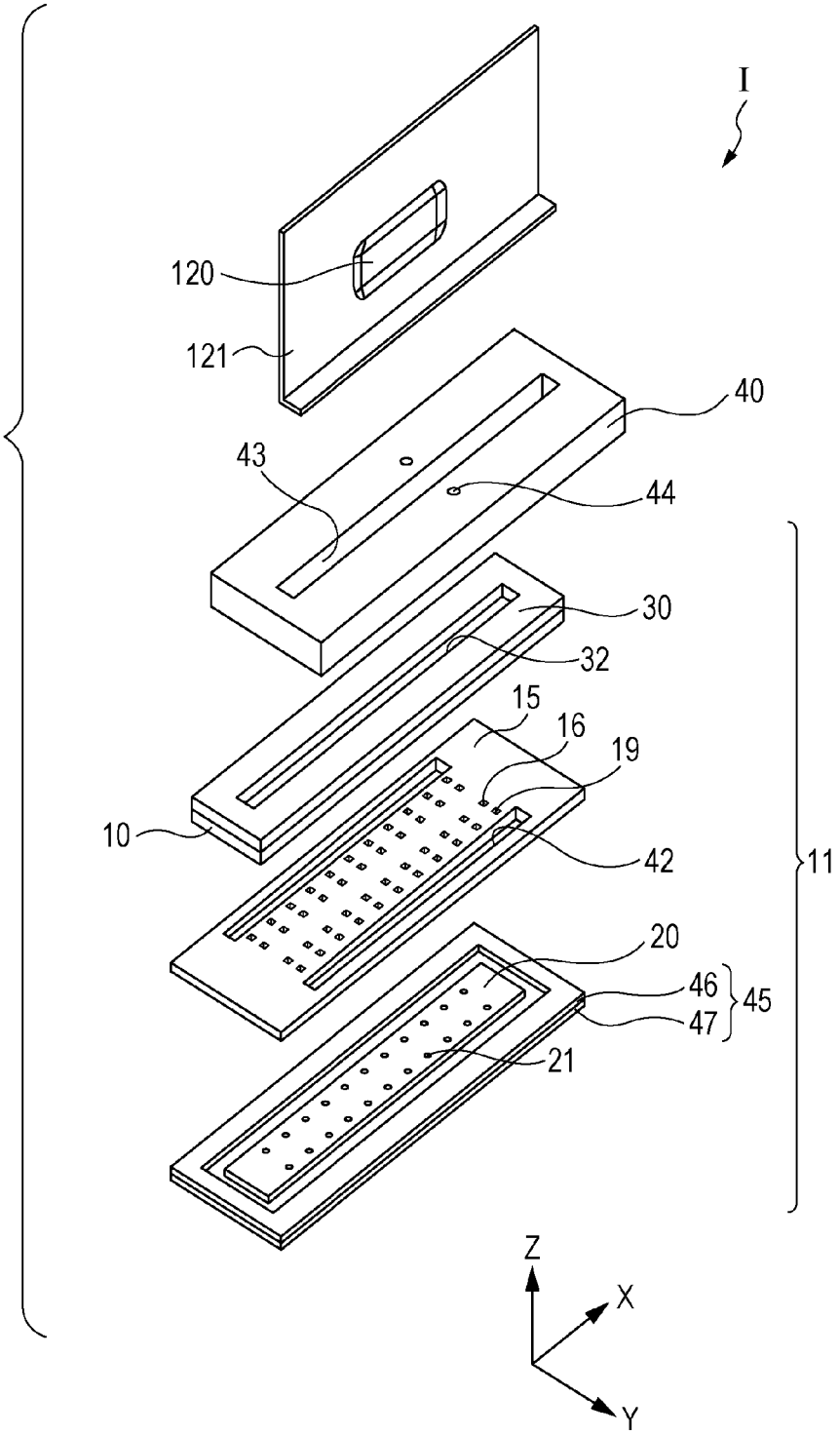
FIG. 1 is an exploded perspective view of a recording head according to Embodiment 1 of the invention.
Figure 2:
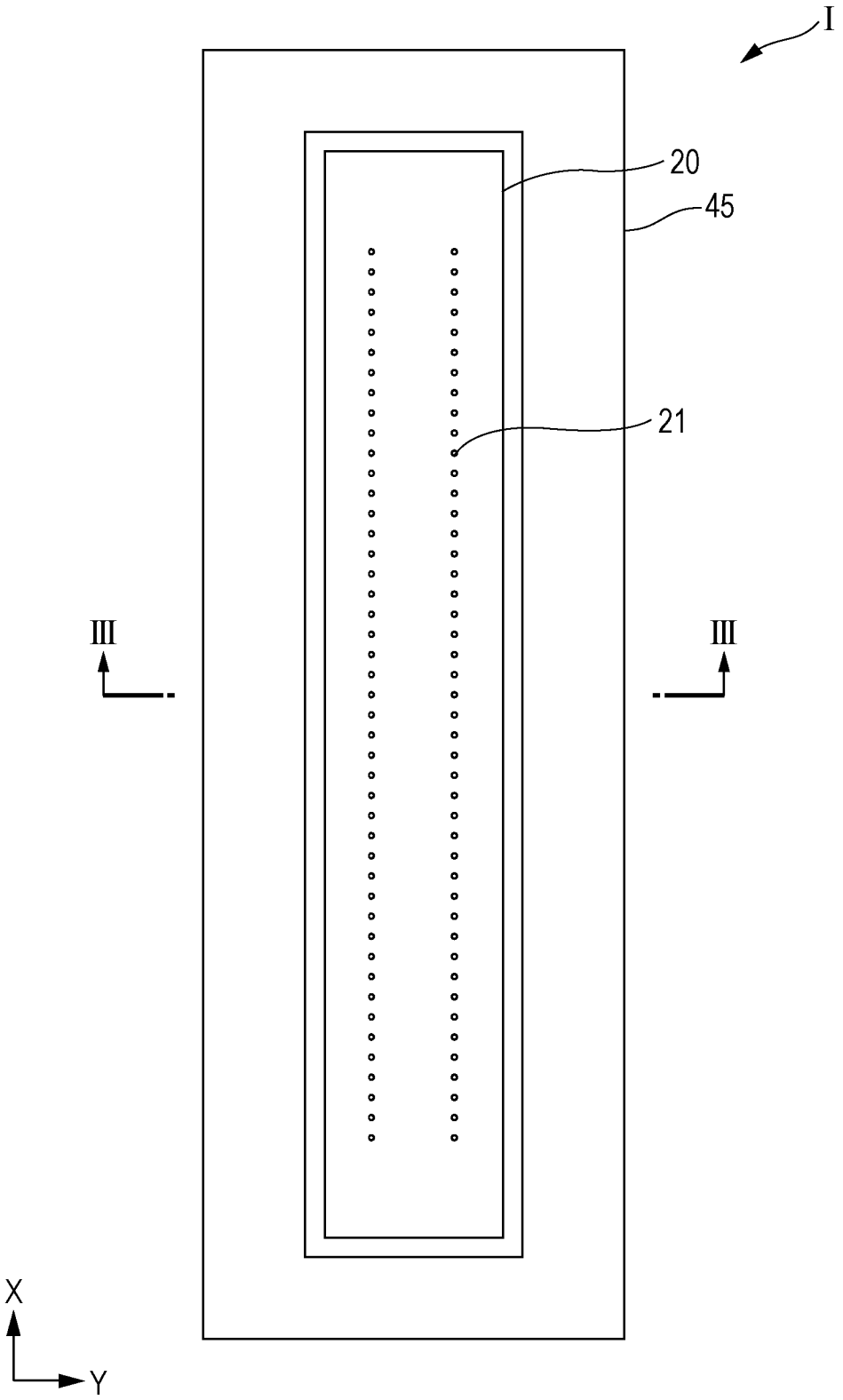
FIG. 2 is a plan view of the recording head according to Embodiment 1 of the invention.
Figure 3:
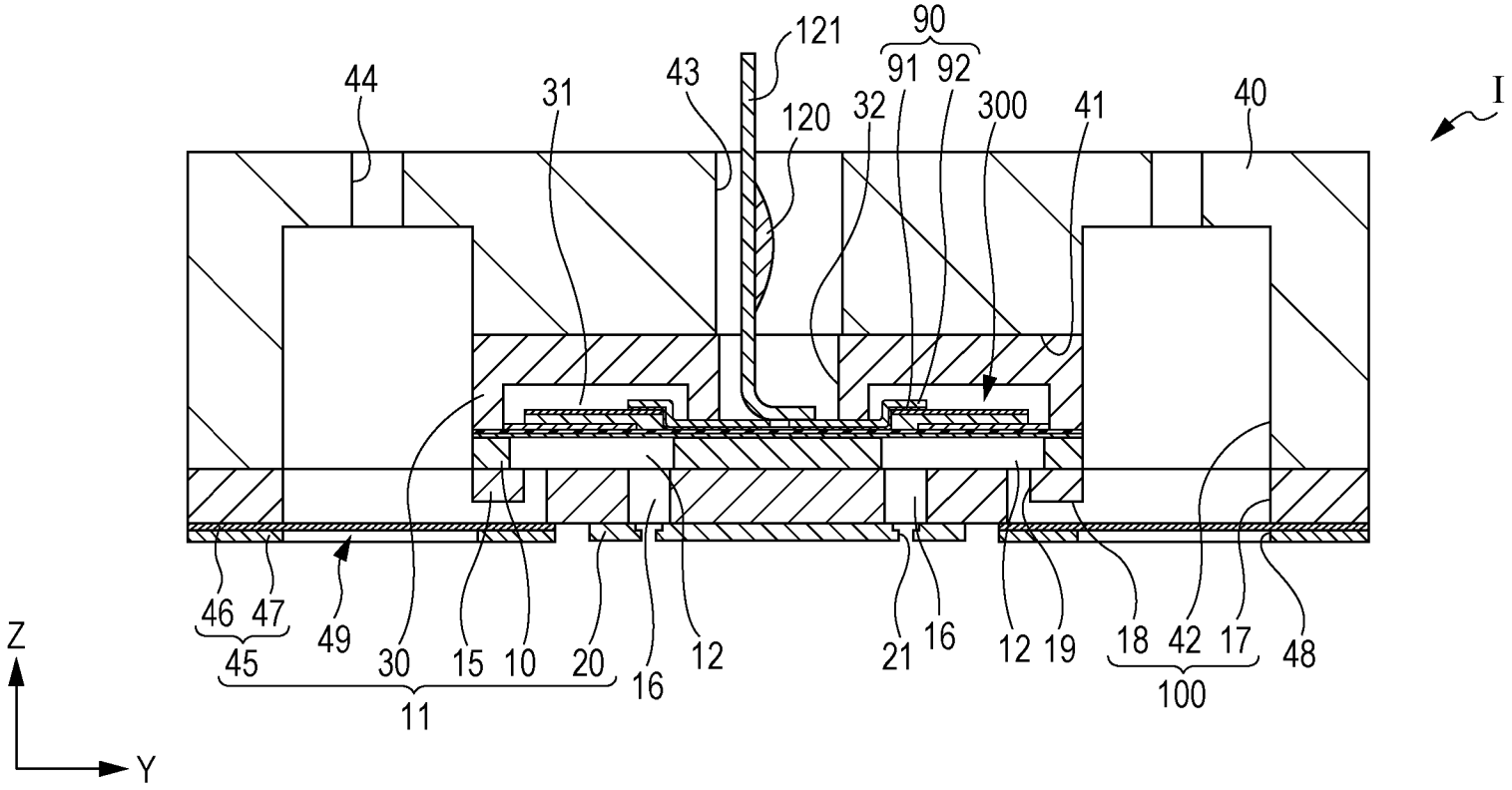
FIG. 3 is a cross-sectional view of the recording head according to Embodiment 1 of the invention.
Figure 4A:
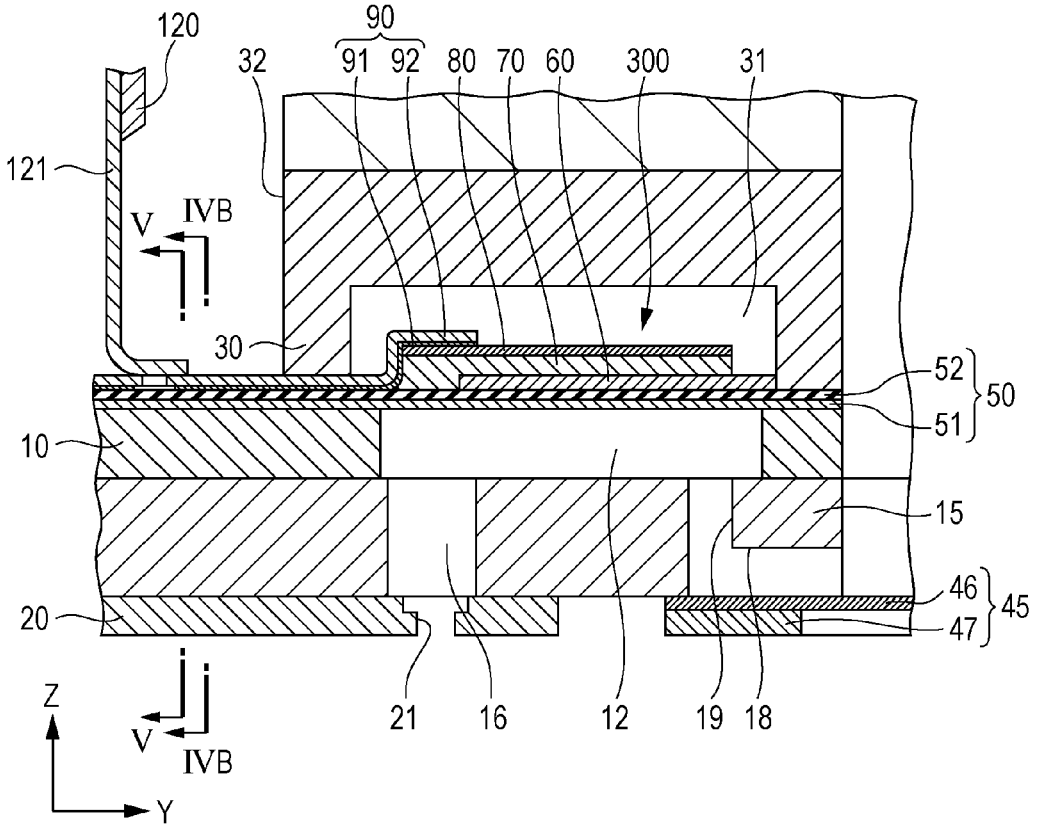
FIGS. 4A and 4B are cross-sectional views in which a main portion of the recording head according to Embodiment 1 of the invention has been enlarged.
Figure 4B:
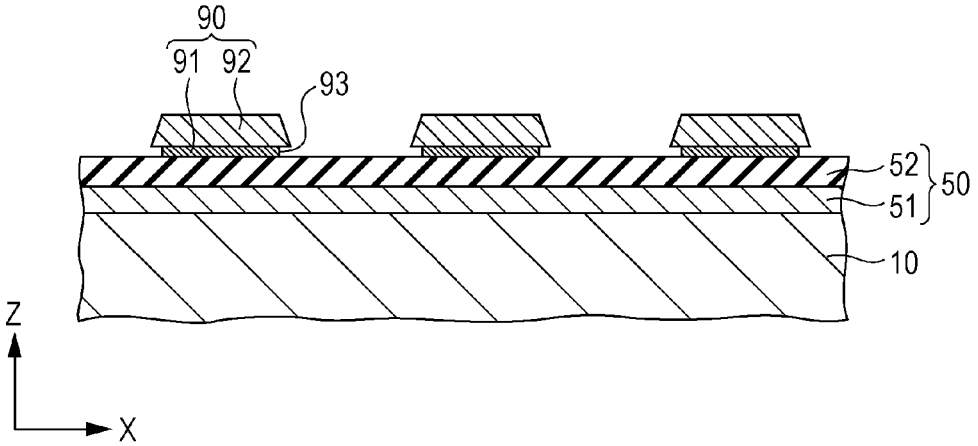
Figure 5:
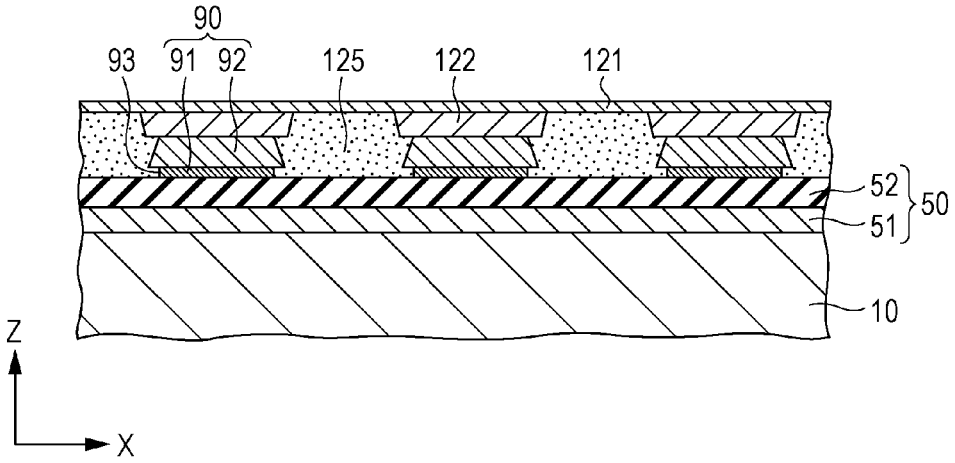
FIG. 5 is a cross-sectional view in which a main portion of the recording head according to Embodiment 1 of the invention has been enlarged.

FIG. 1 is a perspective view of an ink jet type recording head, which is an example of a liquid ejecting head according to Embodiment 1 of the invention, FIG. 2 is a plan view of the ink jet type recording head, FIG. 3 is a cross-sectional view of a line III-III in FIG. 2, FIG. 4A is a view in which a main portion of FIG. 3 has been enlarged and FIG. 4B is a cross-sectional view of a line IVB-IVB in FIG. 3, and FIG. 5 is a cross-sectional view of a line V-V in FIG. 4.

As shown in the drawings, an ink jet type recording head I is provided with a plurality of members such as a head main body 11 and a case member 40, and the plurality of members are joined using an adhesive. In the present embodiment, the head main body 11 is provided with a flow channel formation substrate 10, which is an actuator substrate of the present embodiment, a communication plate 15, a nozzle plate 20, a protective substrate 30, and a compliance substrate 45.

The flow channel formation substrate 10 that forms the head main body 11 is an actuator substrate on which a piezoelectric actuator 300 is provided. A plurality of pressure generation chambers 12, which are partitioned by dividing walls, are arranged in parallel in the flow channel formation substrate 10 along a direction in which a plurality of nozzle openings 21, which discharge ink, are arranged in parallel, by performing anisotropic etching from a surface side of the flow channel formation substrate 10. Hereinafter, the direction thereof will be referred to as an arrangement direction of the pressure generation chambers 12 or a first direction X. In addition, a plurality of rows in which the pressure generation chambers 12 are arranged in parallel in the first direction X are provided in the flow channel formation substrate 10, and in the present embodiment, two rows are provided. Hereinafter, a row arrangement direction in which a plurality of rows of the pressure generation chambers 12 in which the pressure generation chambers 12 are formed along the first direction X, are arranged will be referred to as a second direction Y. Furthermore, in the present embodiment, hereinafter, a direction that is orthogonal to the first direction X and the second direction Y will be referred to as a third direction Z.

In addition, a supply route or the like, the opening area of which is narrower than the pressure generation chambers 12, and which adds a flow channel resistance of ink that flows into the pressure generation chambers 12 may be provided in the flow channel formation substrate 10 on an end portion side in the second direction Y of the pressure generation chambers 12.

In addition, the communication plate 15 is joined to a surface side of the flow channel formation substrate 10. In addition, the nozzle plate 20 through which the plurality of nozzle openings 21, which are in communication with each pressure generation chamber 12, penetrate is joined to the communication plate 15.

A nozzle communication route 16, through which the pressure generation chambers 12 and the nozzle openings 21 are in communication, is provided on the communication plate 15. The communication plate 15 has an area that is larger than that of the flow channel formation substrate 10, and the nozzle plate 20 has an area that is smaller than that of the flow channel formation substrate 10. By making the area of the nozzle plate 20 comparatively small in this manner, it is possible to achieve a reduction in cost.

In addition, a first manifold portion 17 and a second manifold portion 18 that configure portions of a manifold 100 are provided on the communication plate 15.

The first manifold portion 17 is provided to penetrate through the communication plate 15 in the third direction Z.

In addition, the second manifold portion 18 is provided to be open to a nozzle plate 20 side of the communication plate 15 up to partway along the third direction Z without penetrating through the communication plate 15 in the third direction Z.

Furthermore, a supply communication route 19 that is in communication with an end portion in the second direction Y of the pressure generation chambers 12 is provided on the communication plate 15 separately for each pressure generation chamber 12. The supply communication route 19 is in communication with the second manifold portion 18 and the pressure generation chambers 12.

The nozzle openings 21, which are in communication with each pressure generation chamber 12 through the nozzle communication route 16, are formed in the nozzle plate 20. That is, in the nozzle openings 21, openings that eject ink which is a liquid of the same type are arranged in parallel in the first direction X, and rows of the nozzle openings 21 that are arranged in parallel in the first direction X form 2 rows in the second direction Y.

Meanwhile, as shown in FIG. 4, a vibration plate 50 is formed on a surface side of the flow channel formation substrate 10 that is opposite to the communication plate 15. In the present embodiment, an elastic film 51 that is formed from silicon oxide and provided on a flow channel formation substrate 10 side, and an insulating body film 52 that is formed from zirconium oxide and provided on the elastic film 51, are provided as the vibration plate 50. Additionally, a liquid flow channel of the pressure generation chambers 12 and the like, is for example, formed by performing anisotropic etching of the flow channel formation substrate 10 from a surface side in the third direction Z, a surface side to which the communication plate 15 is joined in the present embodiment, and the other surface of the liquid flow channel of the pressure generation chambers 12 and the like is defined by the elastic film 51. Additionally, the vibration plate 50 is not limited to the configuration that is mentioned above, and for example, may be configured by the elastic film 51 only, or may be configured by the insulating body film 52 only. In addition, the vibration plate 50 may have a configuration that includes other films in addition to the elastic film 51 and the insulating body film 52. In addition, the material of the vibration plate 50 is not limited to the materials that are mentioned above.

In addition, on top of the insulating body film 52 of the vibration plate 50, a first electrode 60, a piezoelectric body layer 70 and a second electrode 80 configure the piezoelectric actuator 300, which is formed by lamination thereof using a film formation or a lithography technique. In this instance, the piezoelectric actuator 300 refers to a portion that includes the first electrode 60, the piezoelectric body layer 70 and the second electrode 80. Generally, either one of the electrodes of the piezoelectric actuator 300 is set as a common electrode, and the piezoelectric actuator 300 is configured by patterning the other electrode and the piezoelectric body layer 70 for each pressure generation chamber 12. Further, in this instance, a portion that is configured from either one of the electrodes and the piezoelectric body layer 70 which are patterned, and that generates piezoelectric distortion due to the application of a voltage to both electrodes is referred to as a piezoelectric body active portion. In the present embodiment, the first electrode 60 is set as the common electrode of the piezoelectric actuator 300, and the second electrode 80 is set as an individual electrode of the piezoelectric actuator 300, but no problems are caused in the configuration if this is reversed because of a driving circuit or wiring. Additionally, in the example that is mentioned above, since the first electrode 60 is continuously provided across a plurality of pressure generation chamber 12, the first electrode 60 functions as a portion of the vibration plate, but naturally the invention is not limited to this configuration, and for example, a configuration in which either one or both of the abovementioned elastic film 51 and the insulating body film 52 are not provided, and only the first electrode 60 acts as the vibration plate may also be used.

In addition, a lead electrode 90, which is lead-out wiring of the present embodiment is connected to the second electrode 80 of the piezoelectric actuator 300. More specifically, in the second direction Y, the lead electrode 90 is led out from an end portion of a side of the piezoelectric actuator 300 that is between rows of the second electrodes 80 to the top of the flow channel formation substrate 10. In the present embodiment, since the vibration plate 50 is provided above the flow channel formation substrate 10, the lead electrode 90 is led out to the top of the vibration plate 50 from the second electrode 80. Naturally, the lead electrode 90 may also be led out to the top of the elastic film 51 of the flow channel formation substrate 10, or may be led out to immediately above the flow channel formation substrate 10. In other words, the lead electrode 90 being led out to the top of the flow channel formation substrate 10 includes immediately above the flow channel formation substrate 10, and a state of being interposed in another member, that is, above the flow channel formation substrate 10. Additionally, in the present embodiment, although not shown in the drawings, a common lead electrode that is formed from the same layer as the lead electrode 90, but is electrically independent from the lead electrode 90 is formed from the first electrode 60. Additionally, since the common lead electrode has the same configuration as the lead electrode 90, overlapping description thereof will be omitted.

This kind of lead electrode 90 is provided by laminating an adhesive layer 91 that is provided on the flow channel formation substrate 10 side, and a conductive layer 92 that is formed on the adhesive layer 91 in the third direction Z.

In addition to improving the adhesion between the electrode of the piezoelectric actuator 300, the second electrode 80 in the present embodiment, and the conductive layer 92, the adhesive layer 91 improves the adhesion between a side surface of the flow channel formation substrate 10 on which the piezoelectric actuator 300 is provided, that is, the insulating body film 52 of the vibration plate 50 in the present embodiment, and the conductive layer 92. The material of this kind of adhesive layer 91 may be selected as appropriate depending on the material of the conductive layer 92 and the materials of each electrode of the piezoelectric actuator 300 and the vibration plate 50. In the present embodiment, as the adhesive layer 91, for example, it is possible to use at least one type that is selected from a group that is formed from nickel (Ni), chromium (Cr), nickel chrome (NiCr), tungsten (W), titanium (Ti), titanium oxide ($TiO_x$) and titanium tungsten (TiW). In addition, the adhesive layer 91 is preferably a material that has a higher ionization tendency than the conductive layer 92, and it suitable to use a material with as high an ionization tendency as possible. By using an adhesive layer 91 in which the ionization tendency is high in this manner, it is possible to improve the adhesion with the conductive layer 92 and other layers. That is, since the adhesion of the adhesive layer 91 rises in proportion with the ionization tendency, or in other words, the reactivity thereof, in order to make the adhesion better than the conductive layer 92, it is preferable to use a material in which the ionization tendency is higher than that of the conductive layer 92, and amongst such materials, it is suitable to use a material with as high an ionization tendency as possible. In the present embodiment, nickel chromium (NiCr) was used as the adhesive layer 91. Additionally, since nickel chromium is extremely flexible, nickel chromium is a material that has excellent adhesiveness in which it is unlikely that cracks or the like will form. Naturally, the adhesive layer 91 may have a single-layered structure or may have a structure in which a plurality of layers are laminated, and may be a single material or may be a plural material in which a plurality of materials are mixed.

The conductive layer 92 is provided on the adhesive layer 91, and is preferably a material that has excellent conductivity, that is, a material in which electrical resistance is low. For example, it is possible to include materials that include gold (Au), copper (Cu) or the like as examples of the material of this kind of conductive layer 92. Naturally, the conductive layer 92 may have a single layer or a plurality of layers, and may be a single material or may be a plural material in which a plurality of materials are mixed.

Further, in the present embodiment, as shown in FIG. 4B, the width of the adhesive layer 91 is narrower than the width of the conductive layer 92 in at least the first direction X, which is a parallel arrangement direction of the lead electrode 90. That is, in the first direction X, an end portion of the conductive layer 92 is disposed further toward an outer side than an end portion of the adhesive layer 91. In addition, the end portion of the conductive layer 92 in the first direction X is formed without coming into direct contact with the vibration plate 50 of the flow channel formation substrate 10. In other words, a groove portion 93 that is open to a side surface in the first direction X of the lead electrode 90 is formed in the side surface by a difference in the widths of the adhesive layer 91 and the conductive layer 92. In addition, although not shown in the drawings, in the present embodiment, in the lead electrode 90, in the second direction Y, the width of the adhesive layer 91 is narrower than the width of the conductive layer 92, and the groove portion 93 that is open to the side surface is formed by the difference in the widths.

This kind of lead electrode 90 can for example, be formed using a film formation or a lithography technique. More specifically, the adhesive layer 91 and the conductive layer 92 are sequentially laminated across the entire surface of a surface of the flow channel formation substrate 10 on which the piezoelectric actuator 300 and the like are formed. Next, the conductive layer 92 is patterned in a predetermined shape. Thereafter, the adhesive layer 91 is wet etched. In the wet etching of the adhesive layer 91, by performing the process until the width of the adhesive layer 91 has a narrower width than that of the conductive layer 92 using side etching, it is possible to form the lead electrode 90 of the present embodiment.

In addition, in a case in which etching of a metal film in which films of two or more different metals are laminated, is performed with an etching fluid that is formed from acid, an electrical corrosion reaction occur due to a difference in potential between the differing metals, and the side etching of a metal with a low potential, or in other words, a metal in which the ionization tendency is high proceeds with ease. It is possible to form the adhesive layer 91 with a narrower width than the conductive layer 92 by wet etching the adhesive layer 91 using this electrical corrosion reaction.

In this manner, by making the width of the adhesive layer 91 of the lead electrode 90 narrower than that of the conductive layer 92 in at least the first direction X, which is the parallel arrangement direction, it is possible to increase a distance between mutually adjacent adhesive layers 91. Therefore, when a voltage is applied to the lead electrode 90, it is possible to increase the time until adjacent adhesive layers 91 short-circuit even when components of the most easily ionizable adhesive layer 91 are eluted. In addition, since it is possible to increase a distance between mutually adjacent adhesive layers 91, the field intensity that is applied to adjacent adhesive layers 91 is reduced, it is possible to reduce an elution speed of components that are included in the adhesive layer 91, and therefore, it is possible to increase the time until adjacent adhesive layers 91 short-circuit.

In addition, in the present embodiment, since the width of the conductive layer 92 is not formed with a width that matches that of the adhesive layer 91, it is possible to suppress a circumstance in which the electrical resistance of the conductive layer 92 becomes high. That is, due to increases in the density of the piezoelectric actuator 300 and increases in the density of the lead electrode 90, although it is necessary to make the width of the lead electrode 90 more narrow, if the width of the lead electrode 90 is made narrow, the electrical resistance of the lead electrode 90 is increased and there is a concern that a voltage that is applied to the piezoelectric actuator 300 will fall. In the present embodiment, since it is not necessary to make the width of the conductive layer 92 match that of the adhesive layer 91, it even is possible to suppress falls in voltage by suppressing a circumstance in which an electrical resistance value of the lead electrode 90 is significantly reduced in a case in which the piezoelectric actuator 300 and the lead electrode 90 are disposed with a high density.

Connection wiring 122 of a wiring substrate 121, on which a driving circuit 120 such as a driving IC is mounted, is electrically connected to a second end portion of this kind of lead electrode 90, which is opposite to a first end portion at which the second electrode 80 is connected. Additionally, a connection method of the connection wiring 122 of the wiring substrate 121 and the lead electrode 90 is not particularly limited, but for example, welding using anisotropic conductive paste (ACP or ACF), non-conductive paste (NCP), and a metal such as solder can be used. In the present embodiment, as shown in FIG. 5, the connection wiring 122 of the wiring substrate 121 and the lead electrode 90 are joined using a non-conductive paste 125. In this instance, as shown in FIG. 5, since the groove portion 93 is formed on the side surface of the lead electrode 90 by the difference in the widths of the adhesive layer 91 and the conductive layer 92, the groove portion 93 is filled with the non-conductive paste 125, and as a result, the joining strength of the wiring substrate 121 and the lead electrode 90 is improved due to an anchor effect. Therefore, it is possible to suppress a circumstance in which the electrical connection between the connection wiring 122 of the wiring substrate 121 and the lead electrode 90 is broken. In particular, in a case in which the density of the lead electrode 90 is increased, an electrical connection between the connection wiring 122 and the lead electrode 90 using the non-conductive paste 125 is necessary, but in a case in which the non-conductive paste 125 is used, there is a concern that it will not be possible to reliably secure conduction between the connection wiring 122 and the lead electrode 90. In the present embodiment, by forming the groove portion 93 as a result of the difference in the widths of the adhesive layer 91 and the conductive layer 92 in the side surface of the lead electrode 90, and filling the inside of the groove portion 93 with the non-conductive paste 125, the connection strength of the wiring substrate 121 and the lead electrode 90 is improved due to an anchor effect, and it is possible to reliably perform conduction between the wiring substrate 121 and the lead electrode 90.

In addition, the protective substrate 30 that is substantially the same size as the flow channel formation substrate 10 is joined to a surface of the piezoelectric actuator 300 side of the flow channel formation substrate 10. The protective substrate 30 has a retention portion 31, which is a space for protecting the piezoelectric actuator 300. In addition, a penetration hole 32 that penetrates through a thickness direction (a lamination direction of the flow channel formation substrate 10 and the protective substrate 30) is provided in the protective substrate 30. The end portion of the lead electrode 90 that is opposite to the end portion to which the second electrode 80 is connected is formed inside the penetration hole 32, and the connection wiring 122 of the wiring substrate 121 and the lead electrode 90 are connected by the penetration hole 32.

In addition, the case member 40, which defines the manifold 100 that is in communication with the plurality of pressure generation chambers 12 with the head main body 11, is fixed to the head main body 11 that has this kind of configuration. The case member 40 has substantially the same shape in a plan view as the communication plate 15 that was mentioned above, and in addition to being joined to the protective substrate 30, is also joined to the communication plate 15 that was mentioned above. More specifically, the case member 40 has a concave portion 41 of a depth in which the flow channel formation substrate 10 and the protective substrate 30 are stored on the protective substrate 30 side thereof. The concave portion 41 has an opening area that is larger than a surface of the protective substrate 30 that is joined to the flow channel formation substrate 10. Further, the opening surface of the nozzle plate 20 side of the concave portion 41 is sealed by the communication plate 15 in a state in which the flow channel formation substrate 10 and the like are stored in the concave portion 41. As a result of this configuration, a third manifold portion 42 is defined at an outer peripheral portion of the flow channel formation substrate 10 by the case member 40 and the head main body 11. The manifold 100 is configured by the first manifold portion 17 and the second manifold portion 18 that are provided on the communication plate 15, and the third manifold portion 42 that is defined by the case member 40 and the head main body 11.

Additionally, as the material of the case member 40, for example, it is possible to use a resin, a metal or the like. Incidentally, it is possible to mass produce with low cost by forming the case member 40 using a resin material.

In addition, the compliance substrate 45 is provided on a surface of the communication plate 15 in which the first manifold portion 17 and the second manifold portion 18 are open. The compliance substrate 45 seals an opening of a liquid ejection surface side of the first manifold portion 17 and the second manifold portion 18.

In the present embodiment, this kind of compliance substrate 45 is provided with a sealing film 46, and a fixing substrate 47. The sealing film 46 is formed from a flexible thin film (for example, a thin film with a thickness of 20 μm or less that is formed by polyphenylene sulfide (PPS), stainless steel (SUS) or the like), and the fixing substrate 47 is formed with a hard material such as a metal like stainless steel (SUS) or the like. Since a region of the fixing substrate 47 that opposes the manifold 100 forms an opening portion 48 which is completely removed in the thickness direction, a surface of the manifold 100 forms a compliance portion 49, which is a flexible portion that is sealed by the flexible sealing film 46 only.

Additionally, an introduction route 44 for supplying ink to each manifold 100 is provided in the case member 40 in communication with the manifolds 100. In addition, a connection aperture 43 into which the wiring substrate 121 is inserted is provided in the case member 40 in communication with the penetration hole 32 of the protective substrate 30.

In the ink jet type recording head I that has this kind of configuration, when ink is ejected, ink is taken in from liquid accumulation means through the introduction route 44, and the inside of a flow channel that reaches the nozzle opening 21 from the manifold 100 is filled with ink. Subsequently, deflection deformation of the piezoelectric actuator 300 and the vibration plate 50 is caused by applying a voltage to each piezoelectric actuator 300 that corresponds to the pressure generation chambers 12 according to a signal from the driving circuit 120. As a result of this configuration, the pressure inside the pressure generation chambers 12 increases, and ink droplets are ejected from predetermined nozzle openings 21.

Embodiment 2

Figure 6:
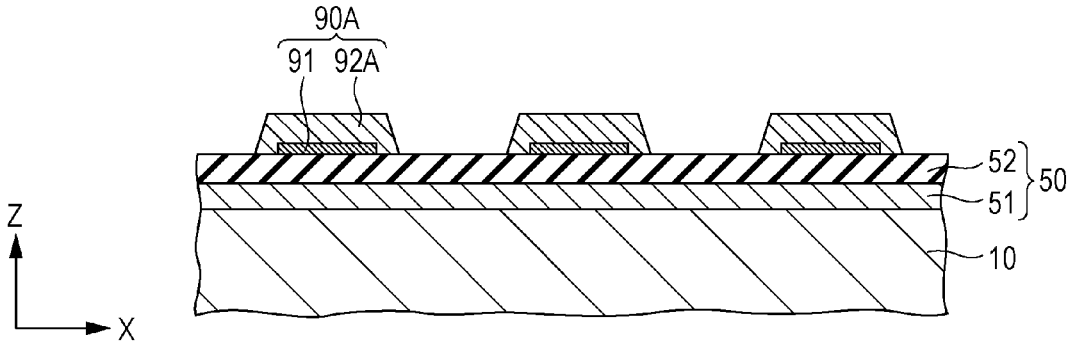
FIG. 6 is a cross-sectional view in which a main portion of a recording head according to Embodiment 2 of the invention has been enlarged.

FIG. 6 is a cross-sectional view in which a main portion of an ink jet type recording head, which is an example of a liquid ejecting head according to Embodiment 2 of the invention has been enlarged. Additionally, the same reference numerals are applied to members which are the same as in the abovementioned Embodiment 1, and overlapping descriptions thereof have been omitted.

As shown in FIG. 6, a lead electrode 90A of the present embodiment is provided with an adhesive layer 91 that is provided on the flow channel formation substrate 10, and a conductive layer 92A that is provided on the adhesive layer 91.

The adhesive layer 91 is provided with a narrower width than the conductive layer 92A in at least the first direction X, which the parallel arrangement direction of the lead electrode 90.

In addition, in the first direction X, which is the parallel arrangement direction of the lead electrode 90A, the conductive layer 92A is formed to cover the adhesive layer 91. That is, the conductive layer 92A is formed to come into contact with the vibration plate 50 of the flow channel formation substrate 10 on an outer side of an end surface of the adhesive layer 91.

In the lead electrode 90A with this kind of configuration, since the adhesive layer 91 is covered with the conductive layer 92A, it is unlikely that components that are included in the adhesive layer 91 will be eluted, even when a voltage is applied to the lead electrode 90A, and it is possible to suppress defects such short-circuiting of adjacent lead electrodes 90A.

Additionally, in the present embodiment, unlike the abovementioned embodiment 1, the groove portion 93 is not formed on the side surface of the lead electrode 90A in the first direction X, which is the parallel arrangement direction, but a configuration in which a concave groove portion is formed in the side surface of the conductive layer 92 in the same manner as the abovementioned Embodiment 1, may also be used. That is, if a concave groove portion is formed in the surface of the conductive layer 92, in the same manner as the Embodiment 1, it is possible to achieve an improvement in joining strength due to an anchor effect of the non-conductive paste 125. Additionally, in a case in which the groove portion is formed in the side surface of the conductive layer 92, the groove portion may be a continuous groove portion, and may be a groove portion that is formed intermittently. In addition, even if a portion of the adhesive layer 91 is exposed by the groove portion, in the same manner as the Embodiment 1, since it is possible to increase an interval between adjacent adhesive layers 91, it is possible to reduce the field intensity and suppress the elution of components.

Other Embodiments

Embodiments of the invention have been described above, but the basic configuration of the invention is not intended to be limited by the abovementioned statements.

For example, in the abovementioned Embodiments 1 and 2, a configuration in which the flow channel formation substrate 10 is shown as an example of the actuator substrate on which the piezoelectric actuator 300 is provided, is used, but as long as the actuator substrate is a substrate on which the piezoelectric actuator 300 is provided, the actuator substrate is not particularly limited.

In addition, in the abovementioned Embodiment 1, as the lead electrode 90 or 90A, which is the lead-out wiring, configurations in which the adhesive layer 91 and the conductive layer 92 or 92A are provided are used as examples, but the configuration of the lead electrode 90 is not particularly limited to this, and may include other layers between the adhesive layer 91 and the conductive layer 92 or 92A. In addition, a configuration that includes other layer on a side of the conductive layer 92 or 92A that is opposite to the adhesive layer 91 may also be used.

Furthermore, in the abovementioned Embodiments 1 and 2, description was given using a thin film type piezoelectric actuator as the piezoelectric actuator 300 that generates a pressure change in the pressure generation chambers 12, but the configuration is not particularly limited to this, and for example, thick film type piezoelectric actuator that is formed using a method such as pasting of green sheets together, a longitudinal vibration type piezoelectric actuator in which a piezoelectric material and an electrode forming material are alternately laminated and that causes extension in an axial direction or the like can be used.

Figure 7:
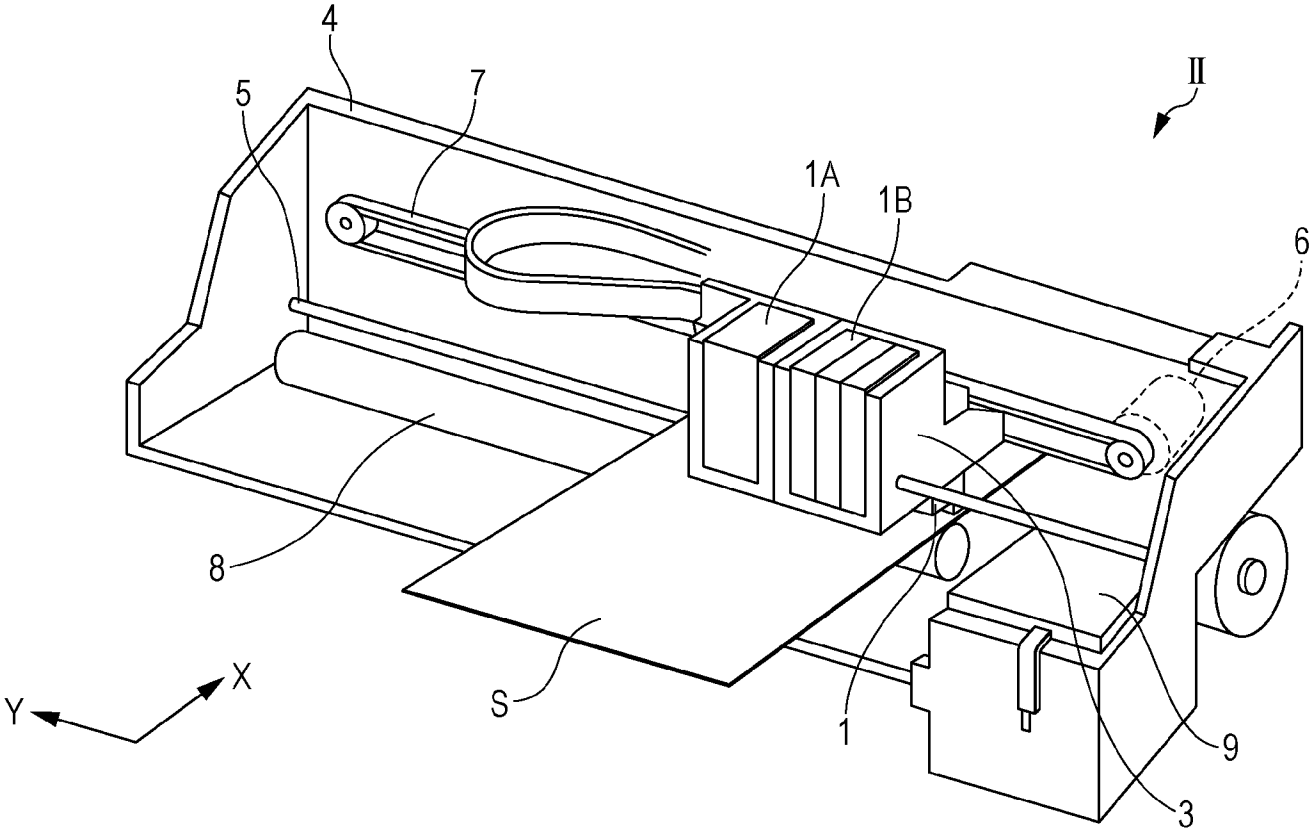
FIG. 7 is a schematic perspective view that shows a liquid ejecting apparatus as in the first embodiment of the invention.

In addition, as shown in FIG. 7, the ink jet type recording head I is for example, installed in an ink jet type recording apparatus II. Ink cartridges 1A and 1B, which are liquid accumulation means, are provided in a detachable manner in a recording head unit 1 that includes the ink jet type recording head I, and a carriage 3 in which the recording head unit 1 is installed is provided so as to be capable of moving in an axial direction on a carriage axis 5 that is attached to an apparatus main body 4. The recording head unit 1 ejects for example, a black ink composition and a color ink composition.

Further, the carriage 3 in which the recording head unit 1 is installed moves along the carriage axis 5 as a result of driving power of a driving motor 6 (not shown in the drawings) being transmitted to the carriage 3 through a plurality of gears and a timing belt 7. Meanwhile, a transport roller 8 is provided in the apparatus main body 4 as transport means, and recording sheets S, which are a recording medium such as paper are transported by the transport roller 8. Additionally, the transport means that transports the recording sheets S are not limited to a transport roller and may be a belt, a drum or the like.

Additionally, in the abovementioned example, a configuration in which the ink jet type recording head I is installed in a carriage 3 and moves in a main scanning direction is used as an example of the ink jet type recording apparatus II, but the configuration thereof is not particularly limited. For example, the ink jet type recording apparatus II may be a so-called line type recording apparatus that fixes the ink jet type recording head I and performs printing by moving recording sheets S such as paper in a sub scanning direction.

In addition, in the abovementioned example, the ink jet type recording apparatus II has a configuration in which ink cartridges 1A and 1B, which are liquid accumulation means, are mounted on the carriage 3, but the configuration is not particularly limited and for example, a configuration in which liquid accumulation means such as an ink tank or the like are fixed to the apparatus main body 4, and the accumulation means and the ink jet type recording head I are connected through a supply pipe such as a tube may also be used. In addition, a configuration in which a liquid accumulation means is not installed in the ink jet type recording apparatus may also be used.

In addition, in the abovementioned embodiments, the invention was described using an example of an ink jet type recording head as an example of a liquid ejecting head, but the invention is intended to be used widely in liquid ejecting heads. For example, in addition to various recording heads that are used in image recording apparatuses such as printers, it is possible to include color material ejecting heads that are used in the production of color filters such as liquid crystal displays, electrode material ejecting heads that are used in electrode formation such as organic Electro Luminescence (EL) displays, Field Emission Displays (FED) and the like, organic material ejecting heads that are used in the production of biochips (biotips) and the like as examples of liquid ejecting heads.

What is claimed is:

1. A liquid ejecting head comprising:

an actuator substrate on which a piezoelectric actuator that generates a pressure change in a pressure generation chamber is provided, wherein the pressure generation chamber is in communication with a nozzle opening that ejects a liquid;

lead-out wiring that is led out from the piezoelectric actuator to a top of the actuator substrate, the lead-out wiring including:

an adhesive layer that is provided on an actuator substrate side, and a conductive layer that is provided on a side of the adhesive layer which is opposite the actuator substrate, and wherein the adhesive layer has a width that is narrower than a width of the conductive layer in at least a parallel arrangement direction of the lead-out wiring; and a wiring substrate that includes a connection wiring, wherein the connection wiring is electrically connected to the lead-out wiring, and wherein the lead-out wiring and the actuator substrate, and the wiring substrate and the connection wiring are joined using an adhesive.

2. The liquid ejecting head according to claim 1, wherein a groove portion that is open to a side surface of the lead-out wiring is provided in the side surface.

3. The liquid ejecting head according to claim 1, wherein the conductive layer is formed to cover an end surface in the width direction of the adhesive layer.

4. A liquid ejecting apparatus comprising the liquid ejecting head according to claim 1.

5. A liquid ejecting apparatus comprising the liquid ejecting head according to claim 2.

6. A liquid ejecting apparatus comprising the liquid ejecting head according to claim 3.

7. A liquid ejecting head comprising:

an actuator substrate on which a piezoelectric actuator that generates a pressure change in a pressure generation chamber is provided, wherein the pressure generation chamber is in communication with a nozzle opening that ejects a liquid; and lead-out wiring that is led out from the piezoelectric actuator to a top of the actuator substrate, the lead-out wiring including:

an adhesive layer that is provided on an actuator substrate side, and a conductive layer that is provided on a side of the adhesive layer which is opposite the actuator substrate, wherein the adhesive layer has a width that is narrower than a width of the conductive layer in at least a parallel arrangement direction of the lead-out wiring, and wherein the conductive layer is formed to cover an end surface in the width direction of the adhesive layer.

* * * * *